US006065512A

United States Patent [19]

Munn, II

[11] Patent Number: 6,065,512

[45] Date of Patent: May 23, 2000

[54] FLEXIBLE PANEL

[76] Inventor: John R. Munn, II, 1465 Longwood Dr., Baton Rouge, La. 70808

[21] Appl. No.: 09/190,514

[22] Filed: Nov. 12, 1998

[51] Int. Cl.[7] ..... B65B 1/04

[52] U.S. Cl. ..... 141/391; 141/10; 141/108; 141/313; 141/316

[58] Field of Search ..... 141/10, 108, 114, 141/313, 316, 391; 220/908; 248/95, 97, 99, 152, 174, 907; 229/4.5

[56] References Cited

U.S. PATENT DOCUMENTS

| | | | |
|---|---|---|---|
| 1,879,410 | 9/1932 | Morris et al. | 248/97 |
| 3,822,524 | 7/1974 | Jerpbak | 141/10 |
| 4,037,778 | 7/1977 | Boyle | 248/99 |
| 4,749,011 | 6/1988 | Rylander | 141/316 |
| 4,890,652 | 1/1990 | Hoerner | 141/391 |
| 5,056,679 | 10/1991 | Lonczak | 220/404 |
| 5,716,033 | 2/1998 | Gibson | 248/95 |

*Primary Examiner*—Steven O. Douglas
*Assistant Examiner*—Timothy L. Maust
*Attorney, Agent, or Firm*—Sieberth & Patty, L.L.C.

[57] ABSTRACT

A panel which may be removably inserted into a nonrigid container, which container is comprised of at least one container wall defining a container opening. The panel is characterized at least in that it is formed from a material which is selected from a group consisting of polyvinyl chloride foam board and high impact polystyrene. Preferably, the device is rectangular and defines a centered aperture through each of its width-defining edge portions and a pair of spaced-apart apertures through each of its length-defining edge portions. Among the advantages provided by the device is that it may be repeatedly bent and inserted into a nonrigid container so that, upon release, the container may be retained in an upright and open position for easy access, all without breaking or cracking and without damaging the container either during retention of the container or during its removal therefrom.

11 Claims, 3 Drawing Sheets

FLEXIBLE PANEL

TECHNICAL FIELD

The present invention relates to boards or panels which are sized and configured to hold a nonrigid container in an open and upright position.

BACKGROUND

Plastic bags and other nonrigid containers which have a single opening through which items are placed into the space defined by the container are very popular for their light weight and ease of use. However, the lack of rigidity in such containers can also become an inconvenience when it is desirable to hold the container in an upright and open position while placing items into the container, especially when a single user is attempting to do so. Devices are known which represent others attempts to address this problem. For example, U.S. Pat. No. 4,749,011 to Rylander discloses a substantially planar body which may be bent and inserted into a flexible container and released therein to stretch the wall of the container and hold the container in an open and upright position. While such devices constitute a contribution to the art, the known devices still suffer from their failure to adequately combine flexibility with the ability to retain memory of their original shape so that, upon release after folding and inserting the same into a nonrigid container, the device meets with the interior surface of the container to stretch and retain the container in an upright and open position on a consistent basis during period of repeated use. Rather, the heretofore known devices are fabricated from materials which tend to break after initial or repeated usage, or are not forgiving enough to prevent tearing of conventional plastic bags and similar containers. In addition, the known devices are configured so as to make their insertion into an empty container awkward while also making their removal from a filled container difficult. For example, the devices are configured for removal through the use of asymmetrical application of pulling force which tends to cause the container to tip over during removal of the device.

Accordingly, a need still exists for a panel which is fabricated from material having sufficient rigidity and shape memory to open and retain the container when disposed therein while also being sufficiently flexible and otherwise configured to be easily removed from, and to avoid damage to, the container with which it is used.

SUMMARY OF THE INVENTION

The present invention is deemed to satisfy this need in a highly efficient and effective way. In one embodiment, this invention provides a panel which may be removably inserted into a nonrigid container, the container being of the sort which is comprised of at least one container wall defining a container opening. The panel of this invention is characterized at least in that it is formed from a material which is selected from a group consisting of polyvinyl chloride foam board and high impact polystyrene. These material have been found to impart to the device characteristics which include convenient flexibility, sufficient elasticity and shape memory to enable the device to spring back to its original shape after bending, durability which enables the device to withstand repeated bending and contact with sharp objects, and a combination of forgiveness and sturdiness which prevents damage to a cooperating nonrigid container, e.g., a plastic bag, while being rigid enough to hold the bag in an upright position during use.

In another embodiment, this invention provides a method for filling a nonrigid container which defines at least one opening. The method comprises (a) bending a flat, substantially rectangular panel, the panel being defined at least by two opposing length-defining edge portions and two opposing width-defining edge portions, each width-defining edge portion defining an aperture proximate to its center point, and each length-defining edge portion defining a pair of apertures disposed proximate to respective corner ends of the length-defining edge portion, so that when bent, the width-defining edge portions of the panel are brought into proximity with one another, (b) inserting the panel into the container through the opening so that an imaginary longitudinal axis of the container and an imaginary longitudinal axis of the panel are parallel with one another, (c) releasing the panel, (d) placing a quantity of material into the container, and (e) grasping the panel through the pair of apertures most proximate to the container opening and pulling the panel out of the container. Upon release of the panel of this invention after insertion thereof into the container through the opening, the panel will tend to spring back towards its original shape to cooperate with the container wall(s) so that the container opening and the volume defined by the container are maximized to facilitate access to the interior space of the container, all without damaging the container.

These and other embodiments of this invention will be further appreciated from the ensuing description, drawings and appended drawings.

BRIEF DESCRIPTION OF THE DRAWINGS

In each of the above figures, like numerals and/or letters are used to refer to like or functionally like parts among the several figures.

DETAILED DESCRIPTION OF THE INVENTION

It should be appreciated that the characteristics of the panel of this invention enable a single user to quickly and easily bend and insert the panel into a nonrigid container, release the panel to permit the panel to spring back toward its original shape whereupon it comes into contact with the container wall, the panel and the container forming a substantially cylindrical shape. The panel and the surrounding container then may be placed in an upright position so that the container opening is spread open for easy access to at least a substantial portion of the space within the container.

Figure 1:
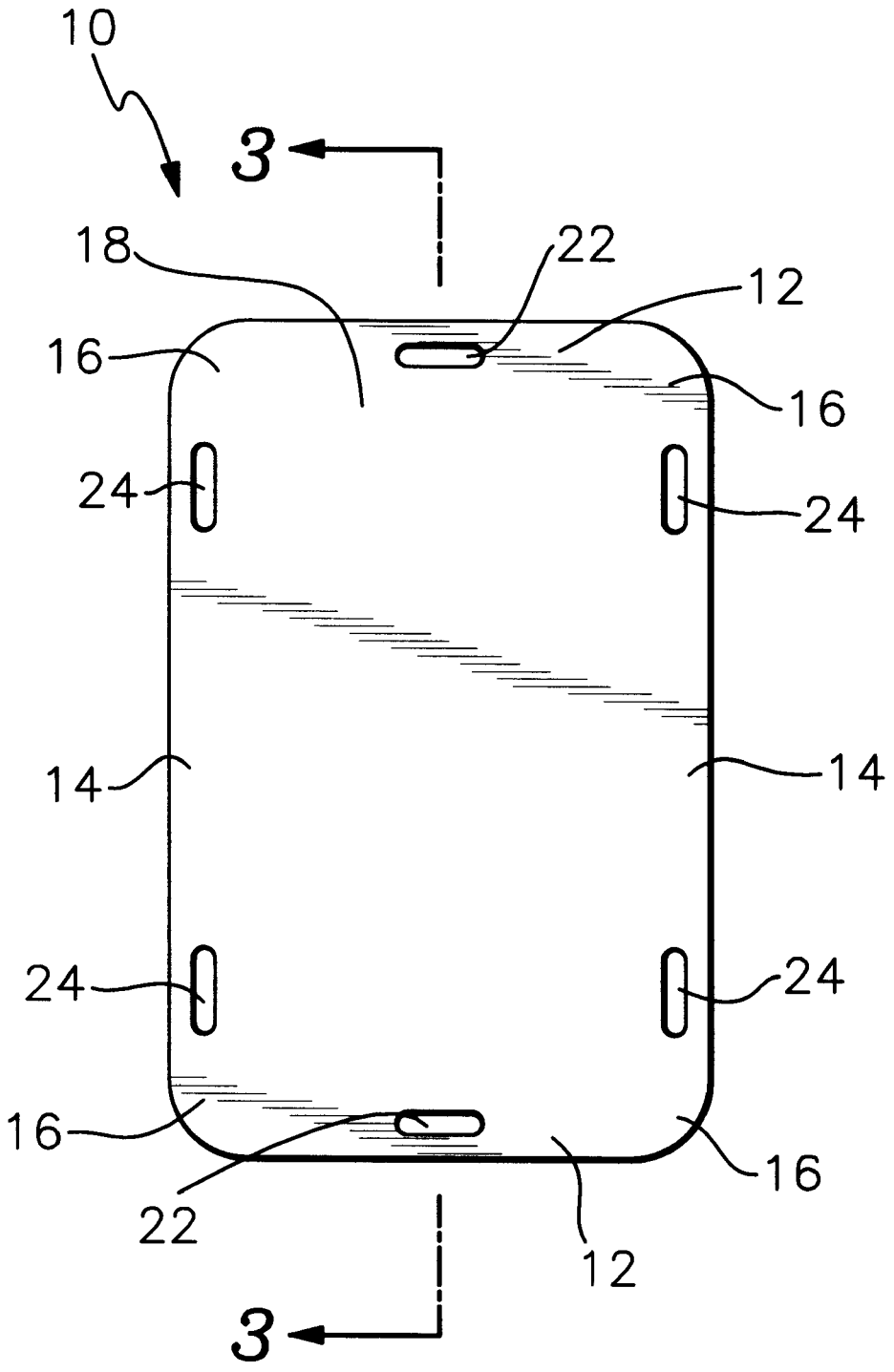
FIG. 1 is a top plan view of a device of this invention.
Figure 2:
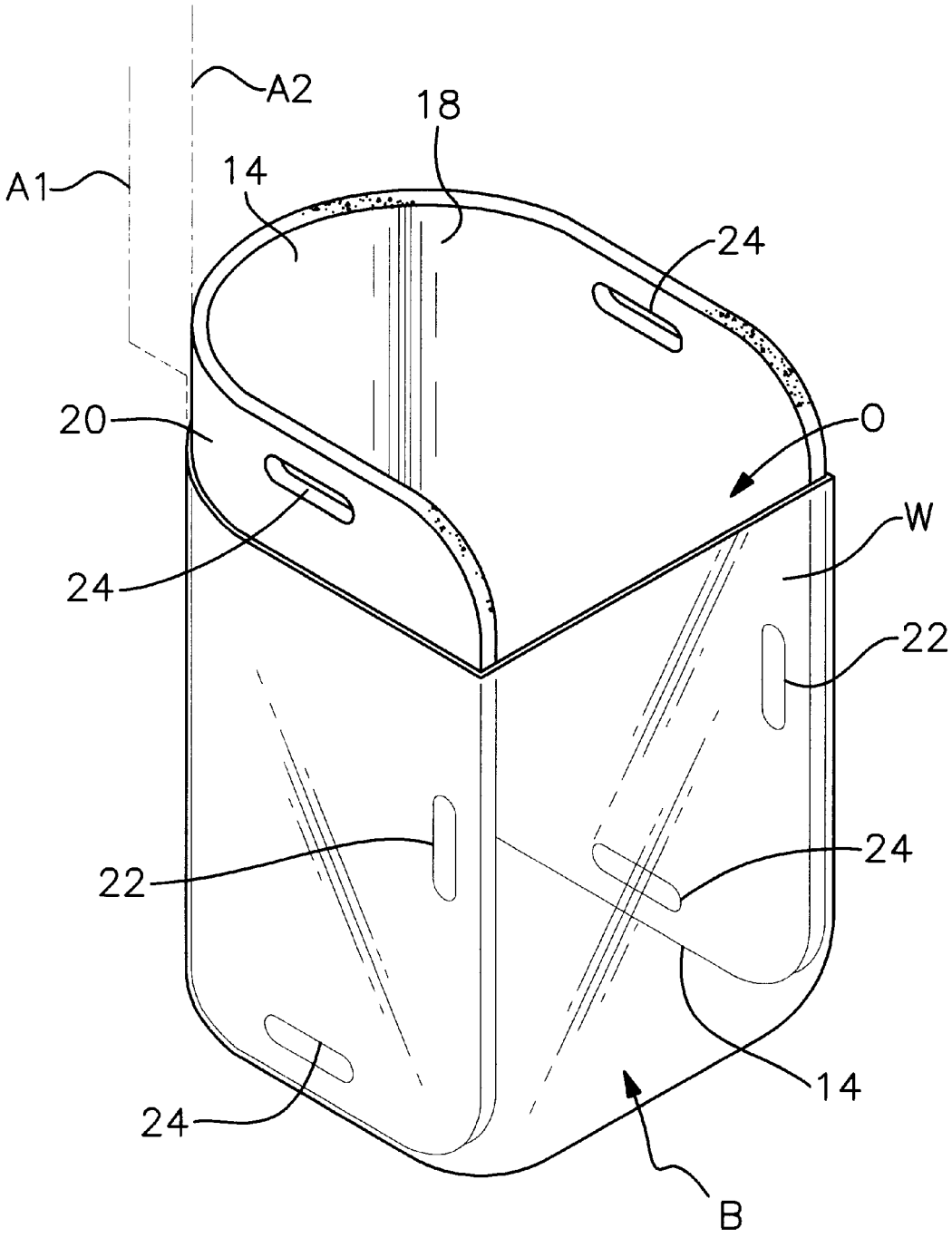
FIG. 2 is an elevated view in perspective of the device of FIG. 1 while in use with a plastic bag.
Figure 3:
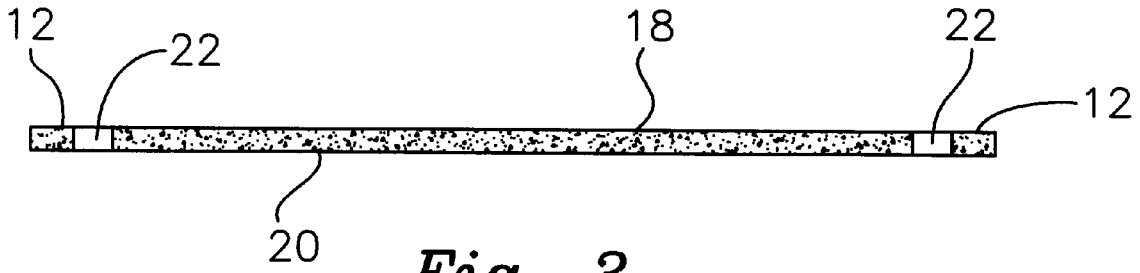
FIG. 3 is a cross sectional view along the line 3,3 indicated on FIG. 1.

Referring now to the accompanying figures, FIGS. 1 and 2 illustrate a preferred device of this invention. The device is comprised of a substantially planar panel 10 made of polyvinyl chloride foam board. Panel 10 has two opposing width-defining edge portions 12 and two opposing length-defining edge portions 14, the edge portions being disposed so as to form four panel rounded corners 16. Panel 10 defines a first face 18 and a second face 20 (FIGS. 2 and 3 only). Each edge portion 12 defines a respective elongate aperture 22 and each edge portion 14 defines a respective pair of elongate apertures 24. Each aperture 22 is proximate to the midpoint (defined relative to the length of the panel) of its respective edge portion 12. Each aperture 24 is proximate to a corresponding corner 16. Each aperture is sized to receive at least a portion of a human hand so that each edge portion may define a handle for grasping the edge portion. In this way, each width-defining edge portion may be grasped conveniently and brought into proximity with the other to bend the panel for insertion into a container.

This particular use of panel 10 is illustrated in FIG. 2. There, panel 10 has been bent, inserted into a plastic bag B through an opening O defined by a container wall W, released and placed in contact with the ground at one of the edge portions 14. Panel 10 remains in a bent position while stretching bag B to maximize the volume of space therein accessible through opening O.

The panel of this invention may be fabricated from either high impact polystyrene or polyvinyl chloride foam board, as well as any other material which has substantially the same unique combination of physical characteristics, namely the flexibility, durability, elasticity and shape memory, possessed by these materials. The dimensions of the panel of this invention may vary widely, depending upon the size of the container with which the panel may be employed, and the physical characteristics desired given the material which is used to fabricate the panel. When the preferred materials are used to fabricate the panel and the container will approximate in dimension a conventional 30 to 45 gallon plastic bag, the panel preferably will be rectangular in shape and will have dimensions of about 1 to about 3 millimeters in average thickness, about 0.3 to about 1 meter in average width, and about 0.75 to about 1.5 meters in average length. Of course, the container with which the panel is used should be nonrigid but sufficiently tear-resistant to withstand the force applied by the panel while the panel springs back toward its original shape. Suitable non-limiting examples of such containers include bags fabricated from plastic, reinforced paper, woven fabric, etc.

As may be seen with particular reference to FIG. 2, in the practice of the method of this invention, once bent, a length-defining edge portion 14 of panel 10 first is inserted into bag B through opening O so that an imaginary longitudinal axis A1 of bag B and an imaginary longitudinal axis A2 of panel 10 are parallel with one another. It will be appreciated that panel 10 is configured to be bent in the direction of either face 18 or face 20, although depicted in FIG. 2 the panel has been bent toward face 18. Upon release of bag B after its insertion into bag B, bag B is stretched into an open position by the elastic and memory characteristics of panel 10 so that a quantity of material (e.g., liquid or solid matter which may be contained by bag B) may be placed conveniently in bag B. When the desired amount of material has been placed into bag B, panel 10 may be grasp by the spaced-apart apertures 24 defined by the portion 14 most proximate to opening O, and panel 10 may be pulled out of bag B with substantially evenly displaced force around portion 14 and opening O. In this way, bag B will tend to remain in upright position while bag B is conveniently removed therefrom. Opening O may then be closed by the user and the panel may be reused.

Figure 4:
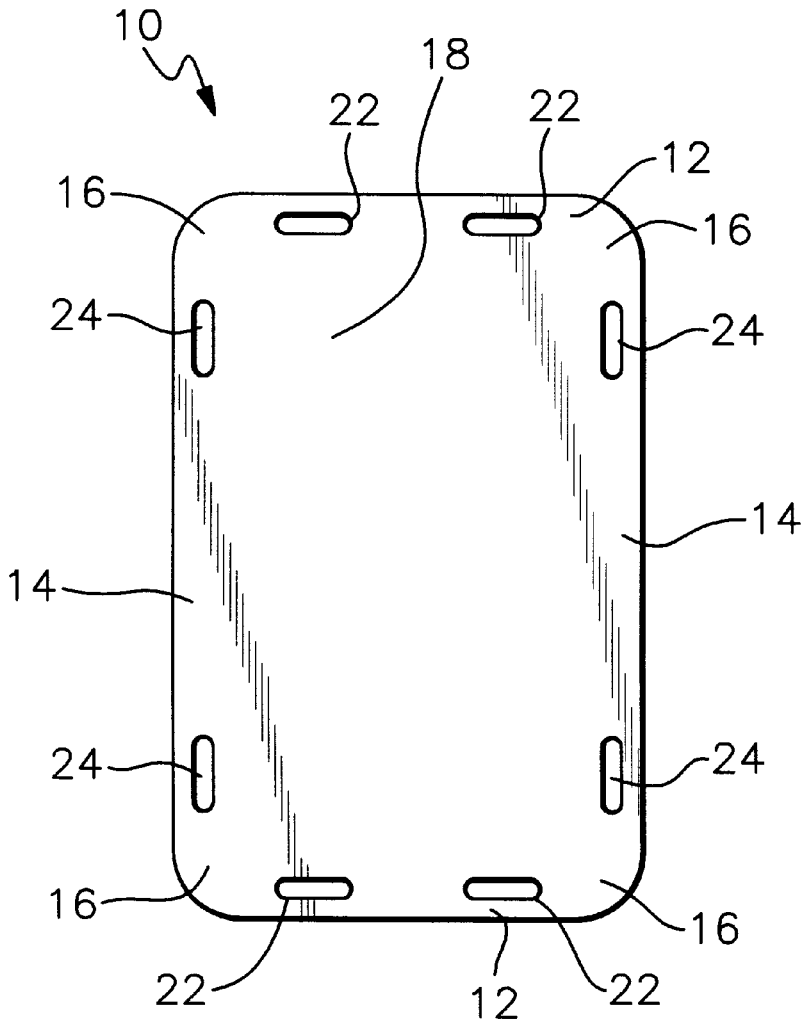
FIG. 4 is a top plan view of another device of this invention.

While in the preferred device depicted in the figures each of the width-defining edge portions defines a pair of apertures and each of the length-defining edge portions defines a single aperture, the number of apertures may vary. Preferably, at least two opposing edge portions each define at least one respective aperture. In another preferred embodiment of this invention, each edge portion defines a pair of apertures to facilitate the use of the device in containers of varying dimensions. See FIG. 4 in this regard. In this way, the device may be configured for use without regard to any particular orientation. That is, the device may be bent in a multitude of directions along its width or along its length to accommodate tall thin containers or short wide containers, all without any detrimental effect upon the functionality of the device.

Each and every U.S. patent or other printed publication referred to herein is incorporated by reference as if fully set forth herein to the maximum extent permitted as a matter of law.

This invention is susceptible to considerable variation in its practice. Therefore, the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A panel which may be removably inserted into a nonrigid container, which container is comprised of at least one container wall defining a container opening, the panel being characterized at least in that it is formed from a material which is selected from a group consisting of polyvinyl chloride foam board and high impact polystyrene, and the shape of the panel is substantially rectangular and defined at least in part by a pair of opposing length-defining panel edge portions and a pair of opposing width-defining panel edge portions, the edge portions also collectively defining at least four rounded panel corners, each edge portion further defining a substantially straight peripheral edge, and one or more of the edge portions defining a pair of apertures.

2. A panel according to claim 1 wherein the material is polyvinyl chloride foam board.

3. A panel according to claim 2 wherein the panel has an average thickness in the range of about 1 to about 3 millimeters.

4. A panel according to claim 1 wherein the panel has an average length in the range of about 0.75 to about 1.5 meters, and an average width in the range of about 0.3 to about 1 meter.

5. A panel according to claim 4 wherein at least each of the width-defining panel edge portions defines a respective aperture.

6. A panel according to claim 5 wherein each of the width-defining panel edge portions defines at least one respective aperture, and each of the length-defining panel edge portions defines at least a pair of respective apertures.

7. A panel according to claim 6 wherein each edge portion defines a pair of respective apertures.

8. A panel according to claim 1 wherein the material is high impact polystyrene.

9. A panel according to claim 8 wherein the panel has an average thickness in the range of about 1 to about 3 millimeters.

10. A panel according to claim 9 wherein the panel has an average length in the range of about 0.75 to about 1.5 meters, and an average width in the range of about 0.3 to about 1 meter.

11. A method for filling a nonrigid container which defines at least one opening, the method comprising:

a) bending a flat, rectangular panel, the panel being defined at least by two opposing length-defining edge portions and two opposing width-defining edge portions, each width-defining edge portion defining an aperture proximate to its midpoint and a respective substantially straight peripheral edge, and each length-defining edge portion defining a pair of apertures and a respective substantially straight peripheral edge, each aperture of the pair being disposed proximate to a respective end of the width-defining edge portion, so that when the panel is bent along its length, the width-defining edge portions are brought into proximity with one another, b) inserting the panel into the container through the opening so that an imaginary longitudinal axis of the container and an imaginary longitudinal axis of the panel are parallel with one another, c) releasing the panel, d) placing a quantity of material into the container, and e) grasping the panel through one or more of the apertures and pulling the panel out of the container.

* * * * *